United States Patent [19]

Buchman et al.

[11] 3,958,632

[45] May 25, 1976

[54] WELL PIPE CONNECTOR

[75] Inventors: Michael A. Buchman, Arcadia, Ohio; Neil A. Reinhard, Paonia, Colo.

[73] Assignee: Dicken Manufacturing Company, Arcadia, Ohio

[22] Filed: Aug. 27, 1975

[21] Appl. No.: 608,057

[52] U.S. Cl. ..... 166/85

[51] Int. Cl.[2] ..... E21B 33/03

[58] Field of Search ..... 166/85, 88; 285/18

[56] References Cited

UNITED STATES PATENTS

| | | | |
|---|---|---|---|
| 2,960,166 | 11/1960 | Haydin et al. | 166/85 |
| 3,324,950 | 6/1967 | Andrew | 166/88 |
| 3,430,697 | 3/1969 | Wellstein | 166/85 |
| 3,467,181 | 9/1969 | Maas | 166/88;85 |
| 3,561,796 | 2/1971 | Williams | 166/85 |

*Primary Examiner*—James A. Leppink

*Attorney, Agent, or Firm*—Vincent L. Barker, Jr.

[57] ABSTRACT

A well pipe connector for connecting a horizontal pipe outside a hollow well casing to a vertical pipe extending inside the casing. The connector has a first unit for external connection to the horizontal pipe which first unit is externally secured to the casing over an aperture therein with a hollow sleeve extending therethrough in alignment with the aperture. Extending into the aperture is an annular seat, the lower periphery of which rests upon the lower edge of the aperture with the remainder of the periphery being generally flush with the inner surface of said casing. A blind channel extends from the upper seat edge inside the casing downwardly at an angle outwardly toward the casing exterior. The second unit has an angled fluid passage with one end for connection to the vertical pipe and the other end extending through a generally planar flange adapted to be slidably received by the blind channel of said first unit. The flange is positioned at an angle with respect to said L-shaped passage such that insertion thereof into said channel to connect said first and second units will support said passage in alignment with said hollow sleeve with said one end in vertical downward position. Suitable resilient seals are provided between mating surfaces on said units.

7 Claims, 4 Drawing Figures

WELL PIPE CONNECTOR

BACKGROUND OF THE INVENTION

This invention relates to well pipe connectors which are used in connecting a vertical well pipe within a hollow well casing to a horizontal water discharge pipe which extends into the well casing.

Pitless well systems are so named because they include a hollow steel casing of, perhaps 4–12 inches in diameter, through which a vertical well pipe, a submersible pump and its power lines, etc., are lowered. As is well known to those skilled in the art, the pump is positioned far down in the casing with a vertical pipe extending upwardly therefrom through the casing up toward the ground surface. To avoid problems from freezing, the horizontal water discharge pipe leading to the house or other structure is preferably placed below the frost line and extends into the well casing through an aperture below the ground.

Well adaptor units are provided to detachably connect the vertical pipe within the casing to the horizontal discharge pipe. Most conveniently, such connections can be made from the ground level and usually feature some sort of an interlocking and sealed fit between an angled unit attached to the vertical pipe and a fitting secured to the interior of the well casing and extending through the aperture to provide an attachment for the horizontal pipe.

In order to conserve material and facilitate the drilling of deeper wells, it is desirable to keep the well casing itself as small in diameter as possible. However, the well casing must be large enough to permit passage of the submersible pump, pipe, power wires, etc. This is particularly a problem at the area of the adaptor connecting the vertical to the horizontal pipe. In most cases, the pump itself is of considerable larger size than the vertical pipe and the casing must thus be large enough to permit passage of the pump past the area of the adaptor.

One approach to this problem has been to design a well casing with an enlarged area around the adaptor. Such casing designs are shown in U.S. Pat. Nos. 2,707,030 or 2,918,972. In casings of this type, while this approach allows the protuberance attached to the inside of the well casing to be moved radially outward to open the full diameter of the casing for passage of the pump, it adds an additional cost and difficulty to burying the casing.

An alternative approach in providing a clear passage through the well casing for the pump is to eliminate the internal fixture at the casing aperture and to provide other means for securing the adaptor against the aperture. This approach is disclosed, for example, in U.S. Pat. Nos. 2,949,961 or 2,968,256. In both of these constructions, the adaptor itself features a mechanism for forcing its outlet against the casing aperture by pushing a portion of the adaptor against the diametrically opposite portion of the casing by means of a screw thread or wedge mechanism, etc. Thus, when the adaptor is to be removed, the pushing mechanism is retracted and the entire adaptor can be removed from the casing, leaving the diameter of the casing free for passage of the pump and other parts. This approach, of course, requires a more complex mechanism to create the opposed forces against the casing side wall and also requires a separate sized unit for every casing size.

In view of the desirability of providing a well adaptor which can be attached within the casing to connect the vertical and horizontal well pipes and yet, when removed, will leave the passage within the casing substantially clear, and further in view of the shortcomings of the enlarged casings or complex adaptors of the prior art, it is an object of this invention to provide a simple well adaptor which is easily attached or detached from above the ground level to connect the vertical and horizontal well pipes and which, when detached, leaves the diameter of the casing substantially free for passage of the pump and other materials.

It is yet another object of this invention to provide a clear casing well adaptor system in which the interior parts of the adaptor are standardized to fit any sized casing.

Other objects and advantages of the invention will be apparent to those skilled in the art from the following detailed description thereof, with reference being made to the accompanying drawings in which.

DESCRIPTION OF THE PREFERRED EMBODIMENT

Figure 1:
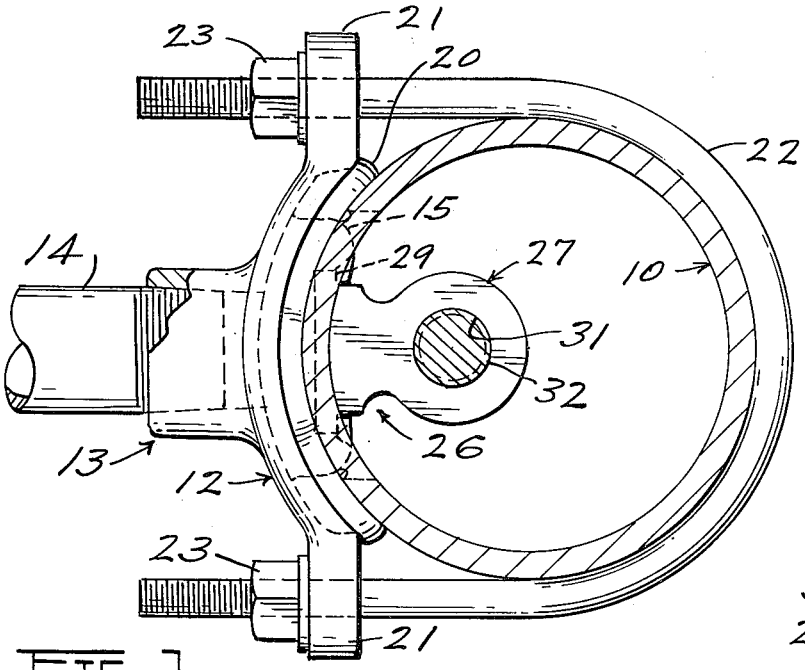
FIG. 1 is a top view of a well casing with the adaptor of this invention attached thereon, as the casing and adaptor would be seen looking down from the ground level.
Figure 2:
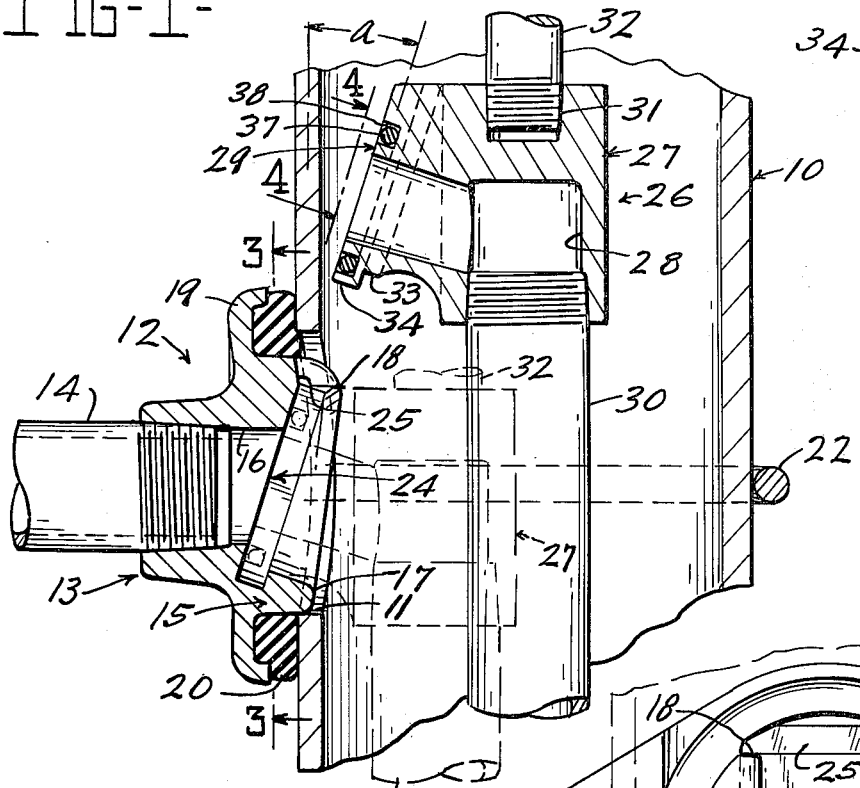
FIG. 2 is a cross sectional view in elevation, through a section of the well casing showing the well adaptor unit of this invention as it is about to be assembled or attached to connect the horizontal and vertical well pipes.

Referring first to FIGS. 1 and 2, a section of a well casing 10 is shown with the well adaptor unit of this invention attached thereon. The well casing 10 is typically a steel pipe of 4–12 inches in diameter buried vertically in the ground and extending downwardly into the well. Positioned below the frost line is a lateral aperture 11, best seen in FIG. 2, which extends through the wall of the casing to provide for attachment of a portion of the well adaptor of this invention. The first or external unit of the well adaptor, generally designated by reference numeral 12, includes a sleeve 13 having interior threads for attachment to the horizontal water discharge pipe 14 which leads from the well to the house or other structure. Extending inwardly from the sleeve 13 is an annular seat 15, best seen in FIG. 2, which includes a lateral passage 16 coaxial with the sleeve 13 to provide a water passage through the entire first unit 12. The annular seat 15 has a lower portion 17 with an external lip which rests upon the edge of the edge or rim of the aperture 11 and an upper portion 18 which protrudes only slightly into the well casing 10 when the unit is in position. On the outside of the well casing 10, a curved lip 19 extends around the outside of the annular seat 15 to provide an annular gasket ring, also seen in FIG. 3, whose diameter is slightly larger than the aperture 11 in the well casing 10. To make a fluid tight seal between the first unit 12 and the well casing 10, a resilient flat gasket 20 or other annular gasket is placed within the curvature of the lip 19 to act as a seal between that surface and the outside of the well casing 10. As seen in FIG. 1, the curved lip extends in an arc around the periphery of the casing so that the flat gasket 20 is forced to assume a position against the exterior of the casing 10 when the external unit 12 is clamped thereon. On each lateral side of the annular seat 15 is an ear or yoke 21 extending outwardly from the curved lip 19 to provide a means for attaching the first unit 12 to the casing. The attaching means shown, which does not form a part of this invention, is a U-bolt 22 which extends around the casing with one end through a passage in each of the ears 21. Each end of the U-bolt 22 is threaded to received a nut 23 which, when drawn tight, will securely draw the external unit 12 toward the casing 10, to create a fluid tight seal around the aperture 11 by means of the flat gasket 20. The advantage of this type of construction is that it can be placed anywhere along the casing 10 where an aperture is located and needs no special attachments or fittings on the outside of the casing 10.

Figure 3:
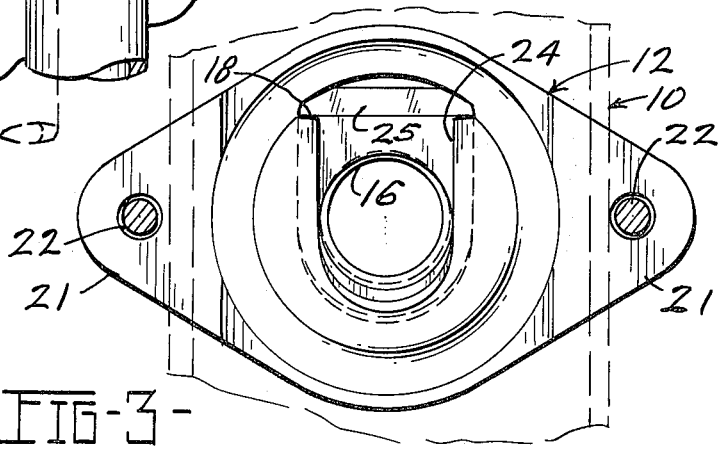
FIG. 3 is a cross sectional view in elevation, taken along the line 3—3 of FIG. 2, and showing the details of construction of the annular seat of the first unit of the well adaptor of this invention.

Referring again to FIG. 2, a blind passage or slot 24 extends downwardly into the annular seat 15 from the upper portion 18 to the lower portion 17. The slot 24 opens at the top in a relieved area 25 and terminates at the bottom in the lower portion 17 at a position spaced from the interior edge of the lower portion 17 and outside of the casing when the external unit is mounted thereon. As is best seen in FIG. 3, the slot or passage 24 forms an open channel extending on either side of the passage 16 which is designed to slidably receive the second or internal unit of the adaptor, designated as reference numeral 26 and shown in FIG. 4. The slot or passage 24 extends at an angle to the axis of the well casing 10, as best seen in FIG. 2. In the preferred embodiment described therein, this angle, designated as A in FIG. 2, is about 20°.

Figure 4:
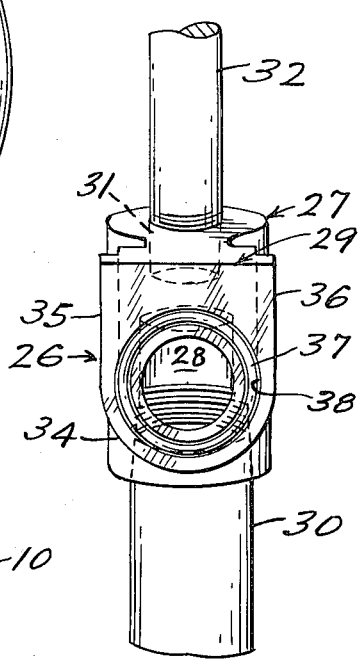
FIG. 4 is a view in elevation showing details of construction of a portion of the second unit of the well adaptor of this invention.

The second or internal unit 26, best seen in FIGS. 2 and 4, includes a body 27 having an angled fluid passage 28 extending from the lower surface thereof upwardly and thence laterally through a flange 29. The lower end of the passage 28 is threaded to receive the vertical well pipe 30. As is known to those skilled in the art, the vertical well pipe 30 supports the entire internal well system and pump so that the strength of the second unit 26 and its threaded area must be substantial. For convenience in handling the adaptor unit from above the ground, a blind hole 31 is threaded to receive a bar 32 which can be inserted from above the ground to attach or detach the unit as will be described below.

The flange 29 on the second or internal unit 26 is positioned at an angle to the axis of the lower portion of the fluid passage 28, as shown in FIG. 2, and is supported by a section 32 of relatively heavy construction which surrounds the lateral portion of the passage 28. As seen in FIG. 2, the angle between the plane of the flange 29 and the axis of the lower portion of the passage 28 and thus the axis of the well casing 10 is the same angle A (preferably 20°) so that when the flange 29 is placed within the slot 24 of the first unit 12, the lower end of the passage 28 and thus its vertical pipe 30 are placed in vertical position, parallel to the axis of the casing. Referring to FIG. 4, the flange 29 includes a generally rounded lower edge 33 with tangential straight sides 34 and 35 adapted to be slidingly received in the blind slot or passage 24.

FIG. 2 shows the first and second units of the well adaptor about to be assembled. As described, the bar 32 can be used to lower the second unit 27 and its supported pipes 30 into the well casing 10 to the position shown in FIG. 2. In this position, continued downward movement by the operator will cause the lower edge 34 of the flange 29 to be guided into the passage 24 by the relieved area 25. As the flange 29 moves into the passage 24, the pipe 30 is positioned in vertical alignment with the casing 10 due to the fact that the angle from vertical of both the flange 29 and slot 24 are the same. Continued downward movement will cause the flange 29 to seat fully within the passage 24 to support the second unit 26 and its water pipe 30. Because the weight of the pump and water pipe 30 is substantial, increasing as the depth of the well increases, it is desirable that the lower section 33 below the flanged area 29 be of substantial strength and be adapted to rest upon the lower portion 17 of the annular seat 15 of the first unit 12. This takes a considerable portion of the force off the edges of the flange 29 itself so that the flange is used primarily to guide the unit into position where it is supported with the lower section 33 resting upon the lower portion 17 of the annular seat. As previously pointed out, the lower edge of the lower portion 17 of the annular seat rests upon the rim of the aperture 11 in the pipe casing to support the entire unit and thus not place an undue strain on the U-bolt or other portions of the first unit 12.

To provide a fluid tight seal when the unit is assembled, an annular recess 37, best seen in FIGS. 2 and 4, is provided in the planar face area of the flange 29 circumjacent the angled fluid passage 28. An oversized O-ring or other seal 38 is placed within the annular recess 37 and will create a fluid tight seal against the opposed surfaces in the slot 24 when the unit is attached.

From the above detailed description of a preferred embodiment of this invention, it will be seen that the adaptor units thus described can be assembled and disassembled from above the ground and is simple in construction with only two parts which slidingly fit together, relying on the weight of the unit to hold them in place. It will also be seen, particularly from inspection of FIG. 2, that when the unit is disassembled, the entire diameter of the well casing 10 is substantially free of obstruction, with only a very slight projection, if any, of the inner portion 18 of the annular seat 15 extending within the casing. It will also be seen that the unit, because of its design, is capable of supporting very large pump and pipe weight because it does not rely upon solely an external attachment means to the pipe casing but rather rests a substantial portion of its weight on the aperture 11 in the pipe casing. Finally, it will be seen that the unit provides the automatic alignment of the vertical pipe 30 because of the angular relationship of the passage 24 and flange 29. It might be noted that this alignment is not affected by tightening or loosening the nuts 23 on the U-bolt 22 which are positioned in a horizontal plane on either side of the first unit 12 and do not affect the angle of the blind passage 24 with respect to the vertical.

Other objects and advantages of the invention will be apparent to those skilled in the art and may be made without departing from the spirit and scope of the attached claims.

We claim:

1. A well pipe connector for connecting an external horizontal pipe to a vertical pipe extending within a hollow well casing, comprising, in combination, a first unit having a sleeve for connection to said horizontal pipe extending through a generally annular seat, said seat having an enlarged external portion for engagement with the exterior of said well casing over an aperture therein and an internal poriton extending into said aperture with its lower periphery resting upon the lower edge of said casing aperture and the remaining periphery being generally flush with the inner surface of said casing with a blind channel extending into said internal portion of said sleeve from the upper periphery thereof downwardly at an angle outwardly toward the casing exterior and terminating in the lower portion of said enlarged external portion; and a second unit for releasable connection to said first unit and including an angled fluid passage having a lower end for connection to said vertical pipe and the other end extending through a generally planar flange adapted to be slideably received by said blind channel on said first unit, said planar flange being positioned at an angle with respect to the lower end of said angled fluid passage whereby said lower end is in vertical position parallel to said casing when said flange is inserted within said blind channel to connect said first and second units to provide a continuous fluid passage between said vertical pipe and said horizontal pipe.

2. The well pipe connector of claim 1 which further includes a resilient annular seal between the opposed faces of said flange and the portion of said first unit within said blind channel and circumjacent the fluid passage therethrough.

3. The well pipe connector of claim 1 wherein the angle between a plane passing through said blind channel and the axis of said well casing is about 20°.

4. The well pipe connector of claim 1 which further includes an elongate member extending upwardly from said second unit whereby said second unit may be manipulated from above the well casing.

5. The well pipe connector of claim 1 wherein said first unit includes a pair of opposed lugs on either side of said enlarged external portion providing means for securing said first unit to said casing externally thereof.

6. A well pipe connection between a horizontal outer pipe and a vertical inner pipe within a hollow well casing, comprising, in combination, a first unit secured to the exterior of said casing over an aperture therein and having a fluid passage extending horizontally through an annular seat, said seat positioned within said aperture with the lower portion thereof supported on the lower edge of said casing aperture and terminating substantially flush with the interior surface of said casing, an upwardly opening blind channel extending downwardly from the inner upper portion of said annular seat and outwardly to terminate in the lower portion of said annular seat outside of said casing, said channel positioned in a plane extending across said fluid passage at an angle such that said plane will not intersect any part of said casing adjacent said casing aperture; and a second unit including a fluid passage extending through a generally planar flange adapted to be received by said blind channel in said first unit, said flange being slideably received in said blind channel from its upper opening and being positioned with respect to the fluid passage in said second unit to support the same in alignment with said fluid passage in said first unit when said flange is inserted in said blind channel.

7. The well pipe connection of claim 6 wherein the angle between the plane of said blind channel and the axis of said well casing is about 20°.

* * * * *